US005355966A

United States Patent [19]

Mathis

[11] Patent Number: 5,355,966

[45] Date of Patent: Oct. 18, 1994

[54] DRILLING METHOD AND AN ASSEMBLY FOR PERFORMING THE METHOD

[76] Inventor: Andrea L. Mathis, Haldenstrasse 14, 8703 Erlenbach, Switzerland

[21] Appl. No.: 84,253

[22] PCT Filed: Oct. 26, 1992

[86] PCT No.: PCT/CH92/00218

§ 371 Date: Jul. 7, 1993

§ 102(e) Date: Jul. 7, 1993

[87] PCT Pub. No.: WO93/09328

PCT Pub. Date: May 13, 1993

[30] Foreign Application Priority Data

Nov. 8, 1991 [CH] Switzerland ..... 3267/91

[51] Int. Cl.[5] ..... E21B 6/00

[52] U.S. Cl. ..... 175/57; 175/103; 175/135; 175/162; 175/171; 175/173

[58] Field of Search ..... 175/57, 92, 103, 135, 175/162, 171, 173, 293

[56] References Cited

U.S. PATENT DOCUMENTS

| | | | |
|---|---|---|---|
| 2,950,087 | 8/1960 | Gregory | 175/103 |
| 3,227,230 | 1/1966 | Lagerstrom | 175/257 |
| 3,231,032 | 1/1966 | Genberg et al. | 175/171 |
| 3,682,260 | 8/1972 | Klemm | 175/92 |
| 3,901,331 | 8/1975 | Djurovic | 175/171 |
| 5,125,464 | 6/1992 | Sabatier | 175/171 X |

FOREIGN PATENT DOCUMENTS

| | | | |
|---|---|---|---|
| 1298066 | 6/1969 | Fed. Rep. of Germany . | |
| 1909931 | 9/1969 | Fed. Rep. of Germany . | |
| 293308 | 9/1971 | Fed. Rep. of Germany . | |
| 125785 | 5/1991 | Japan | 175/293 |

*Primary Examiner*—Hoang C. Dang

*Attorney, Agent, or Firm*—Tarolli, Sundheim & Covell

[57] ABSTRACT

The invention provides a drilling method for drilling a bore-hole in ground or soil, with a percussion drilling device operated directly in the bore-hole and with a rotary percussion drilling device operated from the surface of the ground or soil, both devices being received in a common support member and adapted to be simultaneously operated, and a drilling assembly for preforming this method. In order to avoid a damage of the percussion drilling device, the drilling impact forces and vibrations directed to the rotary percussion drilling device are registered, elastically dampened and absorbed prior to having an effect on the percussion drilling device.

5 Claims, 2 Drawing Sheets

DRILLING METHOD AND AN ASSEMBLY FOR PERFORMING THE METHOD

FIELD OF THE INVENTION

The present invention refers to a drilling method for drilling a bore-hole in ground or soil, with a percussion drilling device operated directly in the bore-hole and with a rotary percussion drilling device operated from the surface of the ground or soil, both devices being received in a common support member and adapted to be simultaneously operated; and a drilling assembly for drilling a bore-hole in ground or soil, comprising a first percussion drilling device operated directly in the bore-hole, a second rotary percussion drilling device operated from the surface of the ground or soil, both said first and second devices being received in a common support member and adapted to be simultaneously operated.

PRIOR ART

A number of different drilling methods and drilling assemblies are known in the art for managing different drilling tasks with the consideration of different ground or soil compositions which can vary not only between one place and another one, but also from the surface of the ground or soil to the bottom thereof. Particularly, the hydraulically operated percussion drilling devices have proven to be effective, which comprise a percussion tube provided with a percussion drilling crown at their one end and which are driven by means of a hydraulically operated rotary impact drilling mechanism. The percussion tube is screwed into a holder which is connected to the rotary impact drilling mechanism whereby it must be ensured that the screwed connection of the percussion tube is not loosened during the drilling operation under the influence of the rotating and impact forces.

The document DE-AS (German Published Patent Application) Nr. 1,298,066 discloses an assembly for the superimposed drilling of holes in rocky ground covered with lose soil or scree materials. The assembly comprises an outer drilling tube with an outer drilling crown and an inner drilling tube with an inner drilling crown. The outer drilling tube and the inner drilling tube are connected to a common flush head member which is to be coupled to a drilling and/or percussion device. Thereby, close to the inner drilling crown, there is provided a deep hole hammer device which forms part of the inner drilling tube.

Further, the document DE-AS (German Published Patent Application) Nr. 1,909,931 discloses an assembly for the superimposed drilling of holes . The assembly comprises an inner drilling tube with an inner drilling crown and an outer drilling tube with an annular drilling crown which is connected to a percussion drilling device. There is provided a separate rotary percussion drilling drive comprising rotary driving means and percussion driving means for both the inner and outer drilling tubes, both of the drive means being controllable independently from each other.

Furthermore, the pneumatically or hydraulically operated percussion hammer devices, the so-called down-the-hole hammers, have also proven to be very effective. These devices also comprise a tube in which, at the one end thereof, there is provided the hammer device with a chisel. Thereby, in these devices, the tube has not to transmit impact forces or torque forces; thus, it is screwed in a holder by means of a simple normal right-handed thread. An impact and rotary effect is created directly, pneumatically or hydraulically, in the down-the-hole hammer device and transformed to the chisel which is an integral part of the hammer.

OBJECTS OF THE INVENTION

In many cases, under corresponding geological conditions, it would be desirable to simultaneously work with a pneumatic down-the-hole hammer situated in the bore-hole and with a percussion drilling machine which is hydraulically or pneumatically operated from the surface. However, this is not possible if the same installation is used, i.e. by providing a down-the-hole hammer in the interior of the impact tube of the percussion drilling device, because the impact forces directed to the percussion drill of the percussion drilling device also affect the down-the-hole hammer and possibly damage the same; furthermore, under adverse conditions, the vibrations could effect a loosening of the tube thread.

Thus, it is an object of the invention to provide a drilling method and an assembly which allow to simultaneously operate with a down-the-hole hammer and a percussion drilling device by using the same installation. Thereby, neither the down-the-hole hammer should be damaged by the impact forces directed to the percussion drilling device nor the tube receiving the down-the-hole hammer should be loosened or removed from its threaded joint.

SUMMARY OF THE INVENTION

To meet these and other objects, the invention provides a drilling method for drilling a bore-hole in ground or soil, with a percussion drilling device operated directly in the bore-hole and with a rotary percussion drilling device operated from the surface of the ground or soil, both devices being received in a common support member and adapted to be simultaneously operated. The drilling impact forces and vibrations directed to the rotary percussion drilling device are registered, elastically dampened and absorbed prior to having an effect on said percussion drilling device.

The invention also provides a drilling assembly for drilling a bore-hole in ground or soil, comprising a first percussion drilling device operated directly in the bore-hole and a second rotary percussion drilling device operated from the surface of the ground or soil. Both said first and second devices are received in a common support member and are adapted to be simultaneously operated. The assembly comprises a drilling hammer with a chisel member connected to an inner tube of the drilling hammer and an outer tube with a drilling crown surrounding the inner tube. The inner tube supporting the drilling crown is connected, via a shock absorber element, to the common supporting member which is coupled to the rotary percussion drilling device.

Preferably, the common holder comprises a connector member for the outer tube, a coaxially arranged inner connector member directed in the same direction for the inner tube and an oppositely directed connector member for the hydraulically operated rotary percussion drilling device. The inner connector member is connected to a nipple consisting of two portions comprising a shock absorber member for absorbing impact forces directed via the inner connector to the inner tube, while the same impact forces in the direction toward the outer connector for the outer percussion tube come into effect to the tube without dampening.

According to a preferred embodiment, the two portions of the nipple are provided at the opposite faces with corresponding flanges between which the shock absorbing member is clamped into position. The two portions of the nipple are located in the bush-shaped housing of the common holder, said holder being in direct connection with the rotary percussion drilling device. The shock absorber member can be constituted by a hydraulically or pneumatically operated shock absorber.

BRIEF DESCRIPTION OF THE DRAWINGS

An embodiment of the assembly is shown in the accompanying drawings and the method is explained with the help of these drawings.

DETAILED DESCRIPTION OF A PREFERRED EMBODIMENT

According to the proposed method, a pre-drilling is performed with a first device, i.e. with the down-the-hole hammer and, in the same course of operation with the help of the same installation, simultaneously a second device operatively connected to the first device is operated, whereby the first device is isolated in a impact-dampening manner from the drilling impacts and vibrations intended to take effect onto the second device. Thus, the mentioned influences are elastically cushioned, absorbed or at least dampened. Thus, the above mentioned drilling impacts take effect practically exclusively onto the second device, i.e. the hydraulically operated percussion drilling device.

Figure 1:
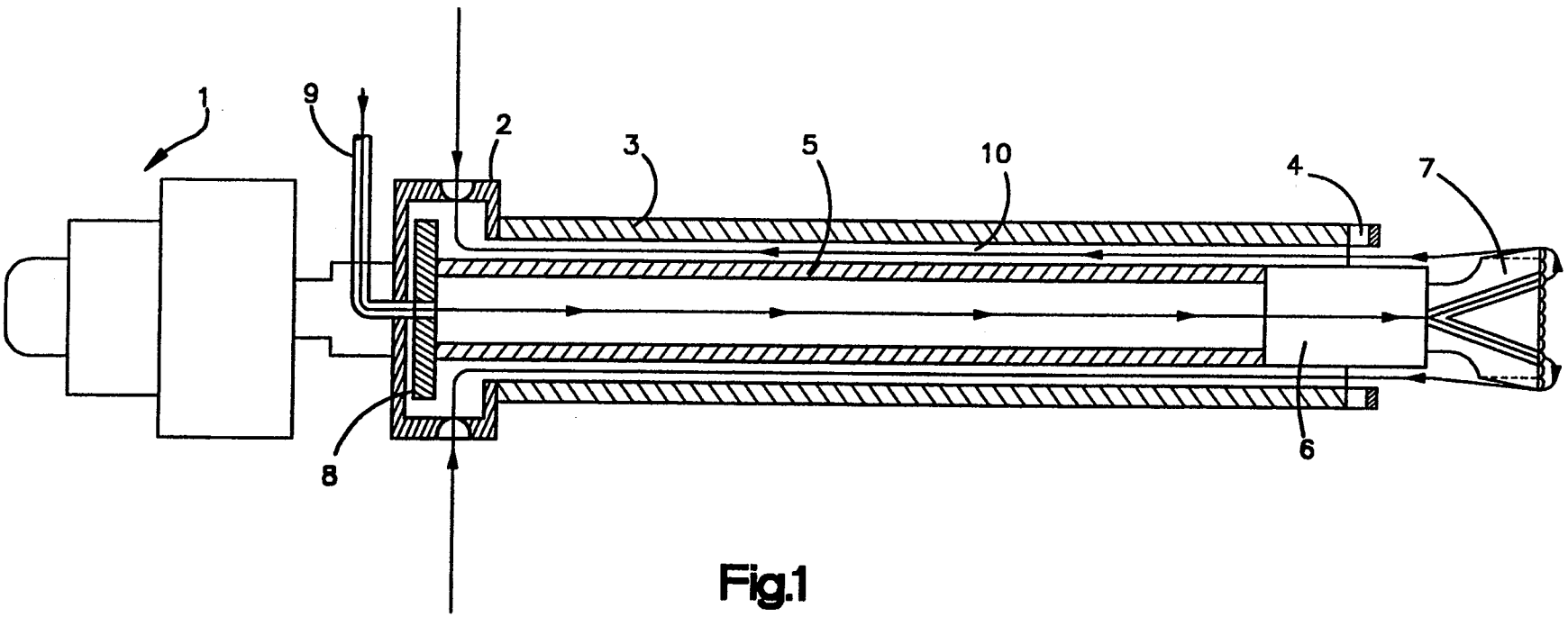
FIG. 1 shows a purely diagrammatic vertically sectioned view of the assembly.

For the illustration, in a first approach, reference is made to FIG. 1 in which there is shown a diagrammatic view of an assembly suitable for performing the method.

A hydraulically operated percussion drilling device is designated with reference numeral 1. Such a device is known and is used in many different ways in drilling assemblies.

Connected to the percussion drilling device is a holder 2 which comprises connections for an impact drilling assembly including an outer percussion tube 3 with a drilling crown 4 as well as for an inner tube 5. The inner tube 5 is equipped, at its end which has to be inserted into the bore-hole, with a pneumatically or hydraulically operated drilling hammer 6. The exact design of the holder 2 will be explained herein below with reference to FIG. 2. The drilling hammer 6 is designed as a down-the-hole hammer having a chisel 7 which protrudes somewhat out of the percussion tube 3 which is surrounded by the inner tube 5, as can be clearly seen in FIG. 1.

The connection of the inner tube 5 to the holder 2 is performed with the help of a shock absorbing member 8 which absorbs or, at least, considerably dampens the impacts and vibrations created by the percussion drilling device 1 to such an extent that these influences no longer have any effect on the inner tube 5 and, thereby, to the drilling hammer 6. On the other hand, the outer percussion tube 3 transforms the impact forces to the drilling crown 4.

A pipe 9 for the supply of a pneumatic operating fluid leads from the outside through the holder 2 and through the inner tube 5 to the drilling hammer 6 to operate the latter one. The air escaping from the chisel 7 exclusively serves for flushing the drilled-out material out of the bore-hole which, thereafter, is led back through the annular chamber 10 to the holder 2 and is finally removed.

Figure 2:
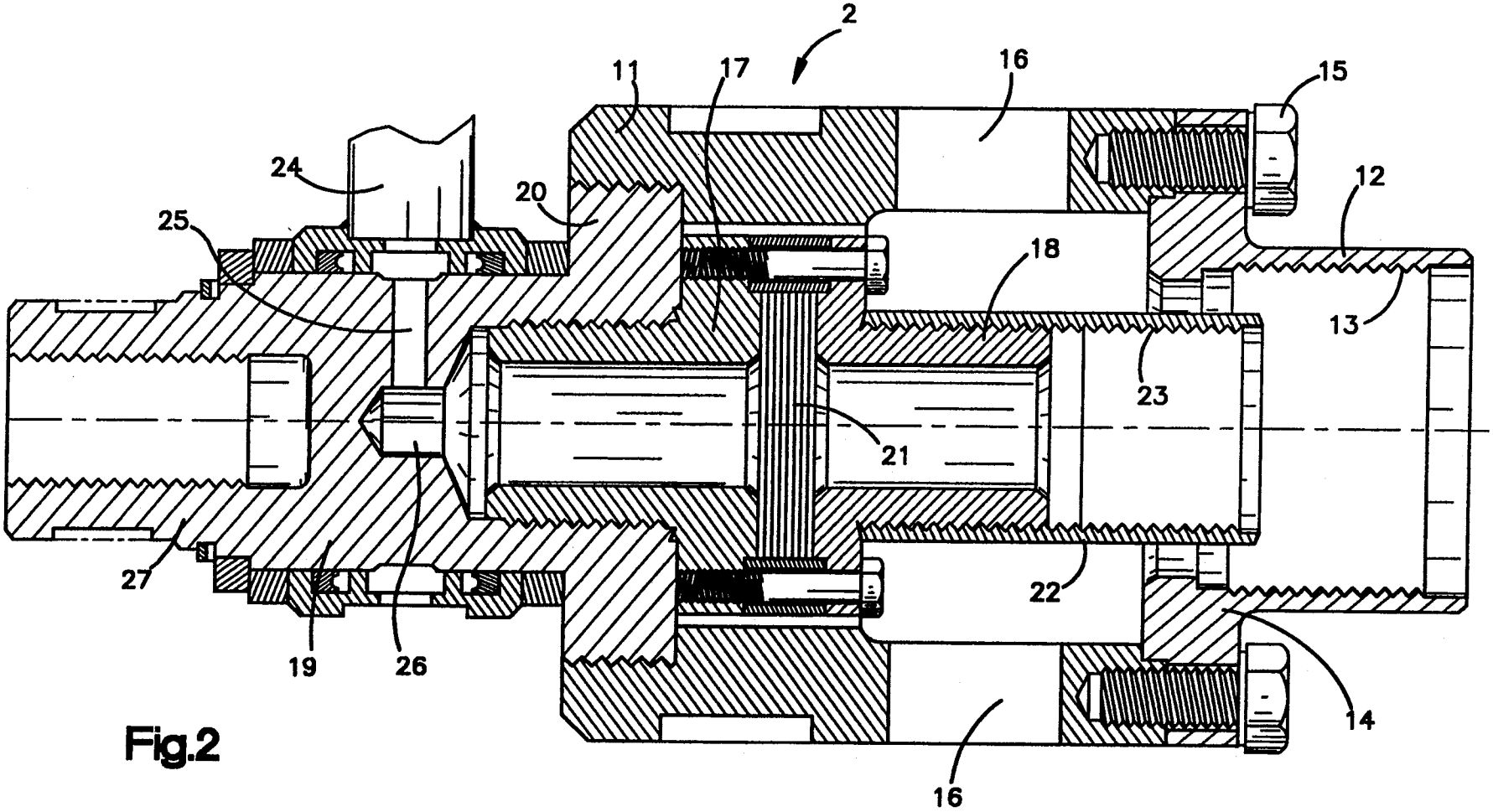
FIG. 2 shows a vertically sectioned view of a holder in a larger scale, as compared to FIG. 1.

In FIG. 2, the holder 2 is shown with its more important design characteristics and details in a larger scale. The holder 2 comprises a tube-shaped housing 11 which is provided, at its one end, with a bush member 12 protruding out of the housing and being provided with an inner thread 13 for the connection of the outer percussion tube 3. The other end of the bush member comprises a flange 14 which is fixed to the facing front surface of the housing 11 by means of screws 15. Two apertures of the housing 11 are designated with reference numeral 16. In the interior of the housing 11, there is provided a two-part nipple, composed of a portion 17 and a portion 18 in coaxial relationship, whereby the first nipple portion 17 is screwed to a head portion 19 which, itself, is screwed into the housing 11 at the open end thereof by means of its flange 20. The head portion 19 is provided with a connector sleeve 27 for a percussion drilling assembly.

Between the two portions 17 and 18 of the nipple, there is clampingly fixed a shock absorber member 21 (designated as element 8 in FIG. 1). This shock absorber member 21 can be constituted by a resilient material, consisting of one or several layers. Important is that the shock absorber element 21 has exceptional shock absorbing properties to practically entirely destroys the impact forces and vibrations created by a percussion drilling device.

In the place of an elastically resilient disc-shaped element, there may be provided a hydraulically or pneumatically operating shock absorber element which can be designed similar to a shock absorber used in vehicles. If a suitable shock absorbing cylinder is used, very strong impact forces can be dampened and absorbed. By adjusting the shock absorbing effect, a simple adjustment of the assembly can be realized with regard to the present requirements.

The percussion drilling device designated with reference numeral 1 in FIG. 1, known per se in the art, is connected to the head portion 19 whereby the created impact forces are transformed by means of the flange 20 not only to the housing 11 but also to the flange of the nipple portion 17. The housing 11 is connected to the percussion tube 3 by means of the bush member 12, and the percussion tube 3 performs the drilling operation under the influence of the impact forces with the help of the drilling crown 4.

The nipple portion 18 which is shock-isolated by the shock absorber member 21 is fixed to a double sleeve 22 which comprises a connector 23 for the inner tube 5. The latter one receives, at its remote end, the drilling hammer 5 with the chisel 7. The drilling hammer 5 is pneumatically operated whereby pressurized air is fed through a suitable pipe (not shown), the pressurized air flowing through a connector 24 and further through apertures 25 and 26 into the nipple portion 17 and, thereafter, through a not shown central bore of the shock absorber member through the nipple portion 18 into the inner tube 5.

In this manner, a very efficient working is made possible in which an exchange of the operating tools can be avoided. The proposed provision of the shock absorber member has the effect that the impact forces of the hydraulically operated rotary percussion drilling device 1 practically exclusively is directed to the outer tube 3 and that the drilling hammer 6 in the interior of the tube 5 is not damaged. Furthermore, a loosening of the threaded connection of the inner tube 5 is excluded since the vibrations of the hydraulically operated rotary percussion drilling device 1 are absorbed by the shock absorber member 21. A simultaneous operation of both devices is made possible, i.e. the bore-hole is drilled by means of the pneumatically operated down-the-hole hammer and, in the same course of operation, the bore-hole is continuously and simultaneously increased in size by the operation of the percussion drilling device coupled with the down-the-hole hammer.

It is also possible to compose the outer percussion tube 3 and/or the inner tube 5 of several partial tube members by a threaded connection whereby the usual left-handed and right-handed threads can be used. Under all circumstances, even inner tubes of sectional design are spared from impact forces and vibrations such that a loosening of the threaded connections is not possible.

I claim:

1. A drilling method for drilling a bore-hole in ground or soil, with a percussion drilling device operated directly in the bore-hole and with a rotary percussion drilling device operated from the surface of the ground or soil, both devices being received in a common support member and adapted to be simultaneously operated, characterized in that drilling impact forces and vibrations directed to said rotary percussion drilling device from the surface are registered, elastically dampened and absorbed prior to having an effect on said percussion drilling device.

2. A drilling assembly for drilling a bore-hole in ground or soil, comprising:

a first percussion drilling device operated directly in the bore-hole;

a second rotary percussion drilling device operated from the surface of the ground or soil;

both said first and second devices being received in a common support member and adapted to be simultaneously operated;

said assembly comprising a drilling hammer with a chisel member connected to an inner tube and an outer tube with a drilling crown surrounding said inner tube;

said inner tube supporting said drilling hammer being connected, via a shock absorber element, to said common support member which is coupled with said rotary percussion drilling device.

3. The assembly according to claim 2 in which said common support member comprises an outer connector member for said outer tube, a coaxially arranged inner connector member directed in the same direction for the inner tube and an oppositely directed connector member for said rotary percussion drilling device, whereby the inner connector member is connected to a nipple consisting of two portions comprising said shock absorber element for absorbing impact forces directed via the inner connector member to the inner tube, while the same impact forces in the direction toward the outer connector member for the outer tube come into effect to the tube without dampening.

4. The assembly according to claim 3 in which said two portions of the nipples are provided at opposite faces with corresponding flanges between which the shock absorber element is clamped into position.

5. The assembly according to claim 4 in which said two portions of the nipple are located in a bush-shaped housing of the common support member, said common support member being in direct connection with the rotary percussion drilling device.

* * * * *